United States Patent [19]

Takada

[11] Patent Number: 4,596,480

[45] Date of Patent: Jun. 24, 1986

[54] RIBBON FEED MECHANISM FOR PRINTER

[75] Inventor: Hiromi Takada, Yokohama, Japan

[73] Assignee: Ricoh Company, Ltd., Tokyo, Japan

[21] Appl. No.: 661,682

[22] Filed: Oct. 17, 1984

[30] Foreign Application Priority Data

Oct. 20, 1983 [JP] Japan ..... 58-196881

[51] Int. Cl.[4] ..... B41J 33/14

[52] U.S. Cl. ..... 400/229; 400/236.2

[58] Field of Search ..... 400/229, 236.2, 221, 400/221.2, 222, 230, 231, 233, 235, 235.1, 236; 74/88, 89.2, 89.21, 89.22

[56] References Cited

U.S. PATENT DOCUMENTS 4,044,883 8/1977 Boehmer ..... 400/236 X 4,232,976 11/1980 Bernardis et al. ..... 400/229 X

FOREIGN PATENT DOCUMENTS 110487 7/1982 Japan ..... 400/233

OTHER PUBLICATIONS

IBM Technical Disclosure Bulletin, vol. 15, No. 7, Dec. 1972, "Ribbon Drive", p. 2312, by Cross.

IBM Technical Disclosure Bulletin, vol. 21, No. 6, Nov. 1978, "Ribbon Feed Interrupt Technique for One-Way Clutch Ribbon Feed Mechanism", pp. 2195–2196, by Haus.

*Primary Examiner*—Charles A. Pearson

*Attorney, Agent, or Firm*—Oblon, Fisher, Spivak, McClelland & Maier

[57] ABSTRACT

A ribbon feed mechanism for a printer which develops a drive force for a printing ribbon utilizing the reciprocating movement of a carriage. Torque is applied to two drive gears through a single wire under tension in response to the movement of the carriage. A ribbon drive gear for feeding the ribbon in a predetermined direction is alternately meshed with the two drive gears during reciprocation of the carriage to be thereby rotated in a predetermined single direction. When the ribbon feed is needless, the tension is removed from the wire.

10 Claims, 7 Drawing Figures

RIBBON FEED MECHANISM FOR PRINTER

BACKGROUND OF THE INVENTION

The present invention relates to a mechanism installed in a printer for feeding a printing ribbon in unison with the movement of a carriage.

A prior art ribbon feed mechanism of the type described uses an exclusive drive motor for ribbon feed built in a carriage on which a ribbon cassette is mounted. Another prior art mechanism drives a ribbon utilizing reciprocating movement of the carriage. The drive motor type mechanism, however, disadvantageously increases the total weight of the carriage and results in an expensive construction. The carriage-aided type mechanism, on the other hand, is incapable of developing the necessary drive force unless a one-way clutch or a drive gear is used. Such not only renders the ribbon feed mechanism intricate but adds to the cost and, in addition, causes ribbon feed even when it is needless such as during tabulated movement or return movement of the carriage.

SUMMARY OF THE INVENTION

It is therefore an object of the present invention to provide a ribbon feed mechanism for a printer which is free from the drawbacks discussed above.

It is another object of the present invention to provide a ribbon feed mechanism for a printer which is remarkably simple in construction and effectively develops a drive force for ribbon feed by utilizing the movement of a carriage, yet without resorting to a one-way clutch or an idle gear.

It is another object of the present invention to provide a generally improved ribbon feed mechanism for a printer.

A ribbon feed mechanism for feeding a printing ribbon which is loaded in a carrier of a printer of the present invention comprises a wire extending under tension in a reciprocating direction of the carriage, first and second drive gears positioned at a predetermined spacing from each other and driven by the wire in a rotational motion in opposite directions to each other, and a ribbon drive gear located to face the first and second drive gears to be rotatable in a predetermined direction in driven mesh with the first drive gear during forward movement of the carriage and in driven mesh with the second drive gear during return movement of the carriage, whereby the ribbon is sequentially fed in response to the movement of the carriage.

In a preferred embodiment, each of the first and second drive gears comprises a feed roller. The wire may be wound around the first and second feed rollers at least one turn each.

The mechanism further comprises a tension control assembly for selectively maintaining the wire under tension and removing the tension. The tension control assembly comprises a spring anchored to one end of the wire for applying tension to the wire. It may further comprise a tension remove portion for removing the tension from the wire against the spring.

Preferably, the tension remove portion is made up of an electromagnetic arm connected with the sring and wire and a solenoid for moving the arm in a direction for removing the tension from the wire.

The above and other objects, features and advantages of the present invention will become more apparent from the following detailed description taken with the accompanying drawings.

DESCRIPTION OF THE PREFERRED EMBODIMENT

While the ribbon feed mechanism for a printer of the present invention is susceptible of numerous physical embodiments, depending upon the environment and requirements of use, a substantial number of the herein shown and described embodiment have been made, tested and used, and all have performed in an eminently satisfactory manner.

Figure 1A:
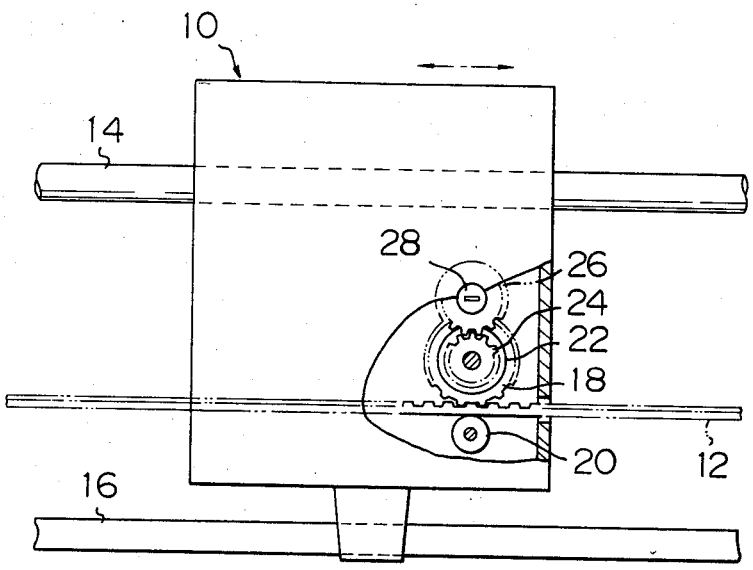
Fig. 1A PRIOR ART
FIG. 1A is a partly taken away plan view of a prior art ribbon feed mechanism for a printer.
Figure 1B:
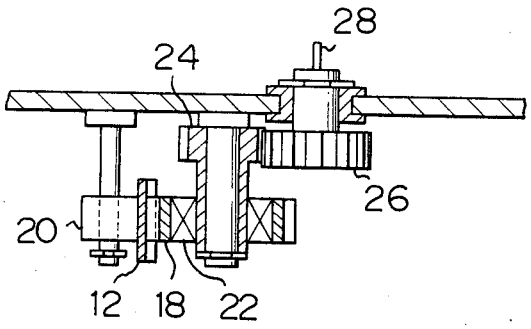
Fig. 1B PRIOR ART
FIG. 1B is a fragmentary side elevation of the mechanism shown in FIG. 1A.
Figure 2:
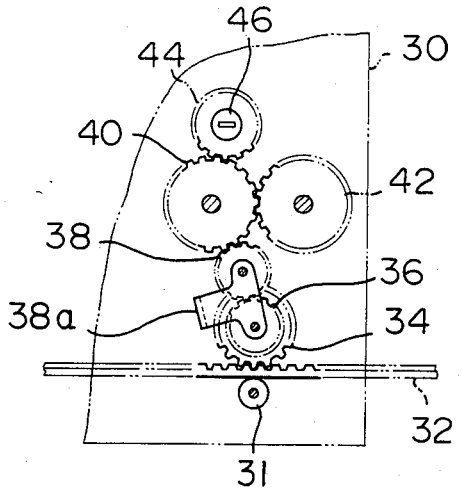
Fig. 2 PRIOR ART
FIG. 2 is a plan view of another prior art ribbon feed mechanism.

Reference will first be made to FIGS. 1A and 1B and 2 for describing two different examples of prior art ribbon feed mechanisms for a printer.

Referring to FIGS. 1A and 1B, a carriage 10 reciprocates on and along carriage guides 14 and 16 as indicated by a doubleheaded arrow. A ribbon feed belt 12 extends in parallel with the carriage guides 14 and 16 and has a rack-like configuration. The belt 12 is engaged by a feed roller 18 and a back-up roller 20. A one-way clutch 22 is associated with the feed roller 18 such that while the carriage 10 moves in a print direction (rightwardly in the drawing) its rotation is transmitted to a ribbon drive gear 24. The reference numeral 26 designates a ribbon drive gear having a ribbon drive shaft 28 therewith.

In the construction shown in FIG. 1A, as the carriage 10 moves in the print direction, a ribbon cassette (not shown) operatively connected with the ribbon feed shaft 28 is caused to feed a ribbon. While the carriage 10 returns to its print start position due to "new line" or the like, the ribbon feed is suspended by the action of the one-way clutch 22. This kind of scheme is undesirable because the one-way clutch 22 is essential and because it is unsuitable for both-way printing by the carriage 10, as dinstinguished from printing which occurs only in one direction.

Another prior art mechanism shown in FIG. 2 is of the type which feeds a ribbon utilizing the movement of a carriage in both directions. A ribbon feed belt 32, like the belt 12 in the first example, is positioned to face a carriage 30 and engaged by a feed roller 34 and a back-up roller 31. A drive gear 36 is provided integrally with the feed roller 34 and engaged by a first idle gear 38. The first idle gear 38 is caused to oscillate through an arm **38*a* in response to the clockwise and counterclockwise rotations of the feed roller 34 and, thereby, alternately mesh with second idle gears 40 and 42 which it faces. In this example, the second idle gears 40 and 42 are held in constant mesh with each other and one of them is meshed with a ribbon drive gear 44. Designated by the reference numeral 46** is a ribbon drive shaft which is engaged with a ribbon take-up shaft of a ribbon cassette (not shown).

While the carriage 30 moves in either direction, the first idle gear 38 constantly meshed with the feed roller 34 is shifted toward the rotation load to be thereby meshed with any of the second idle gears 40 and 42, in turn rotating the ribbon drive gear 44 in a ribbon feed direction. The problem encountered with the mechanism shown in FIG. 2 is that since the ribbon is fed in a predetermined direction in response to each reciprocating stroke of the carriage 30, wasteful ribbon feed occurs even during return strokes of the carriage 30, for example. Another problem is that the construction is intricate and contrary to cost-effectiveness.

A ribbon feed mechanism embodying the present invention which is free from the above-discussed problems will hereinafter be described with reference to FIGS. 3–6.

Figure 3:
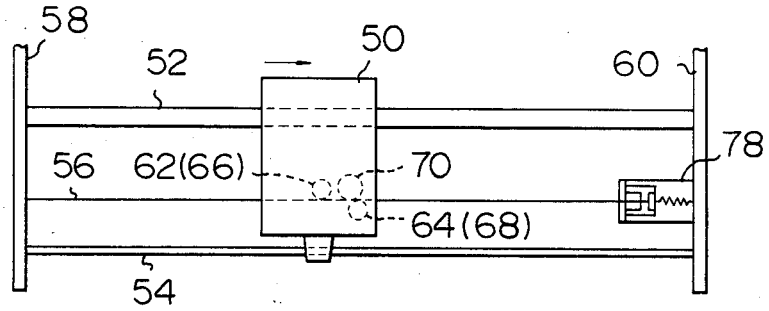
FIG. 3 is a view for explaining movement of a carriage and showing a ribbon feed mechanism embodying the present invention.
Figure 4:
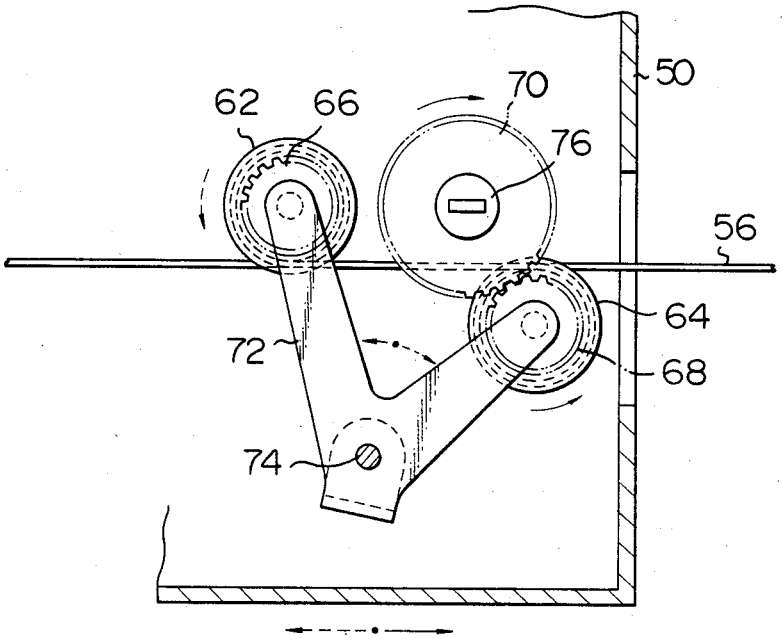
FIG. 4 is a fragmentary enlarged view of of the embodiment shown in FIG. 4.

Referring to FIGS. 3 and 4, a ribbon feed wire 56 spans the distance between opposite frames 58 and 60 along parallel carriage guides 52 and 54 and in a reciprocating direction of a carriage 50. The wire 56 is wound around a feed roller 62 in one direction and around another feed roller 64 in the other direction one turn each, for example. The feed roller 62 is provided with a drive gear 66 integrally and coaxially therewith, and the feed roller 64 a drive gear 68 in the same manner. The feed rollers 62 and 64 are each journalled to a V-shaped bracket 72 at opposite sides of a ribbon drive gear 70, the bracket 72 being swingable in either direction about a pivot shaft 74.

Figure 5:
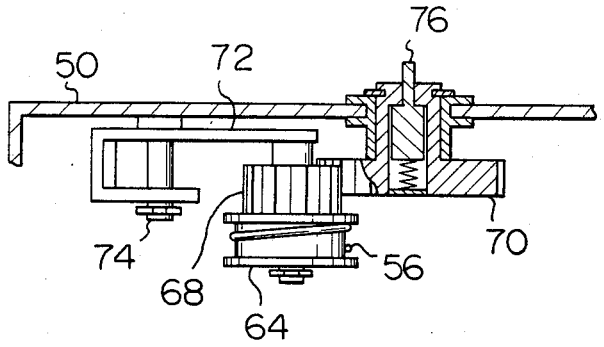
FIG. 5 is a side elevation of the mechanism of FIG. 4 as seen from the right.
Figure 6:
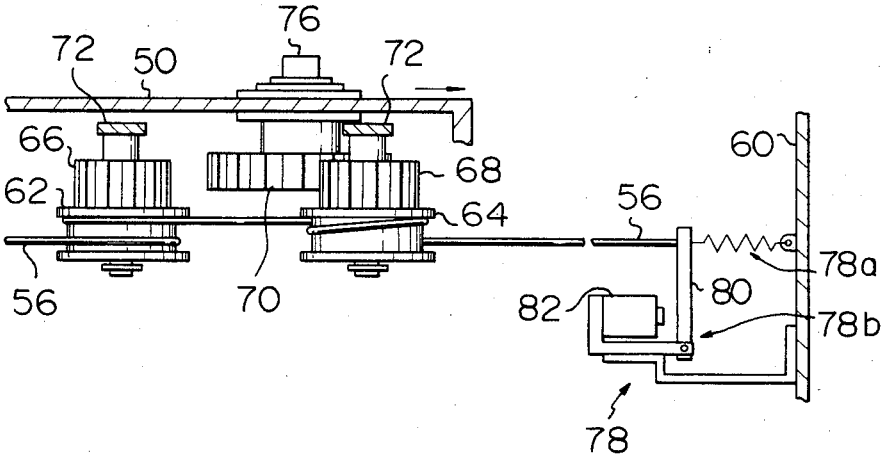
FIG. 6 is a front view of the mechanism shown in FIG. 4.

As also shown in FIG. 5, the ribbon drive gear 70 has a ribbon drive shaft 76 at its center and is journalled to the carriage 50. Meanwhile, the drive gears 66 and 68 carried by the bracket 72 face each other as shown in FIGS. 4 and 6 such that any of them is capable of meshing with the ribbon drive gear 70 associated with a direction of movement of the carriage 50. The feed wire 56 is anchored at one end to the frame 58 and at the other end to a tension control assembly 78 which is located in the vicinity of the other frame 60. The tension control assembly 78 is made up of a tension apply section **78*a* which may comprise a spring, and a tension remove section 78*b* which may comprise an electromagnetic arm 80 and a solenoid 82. In a usual condition, the tension apply section 78*a* serves to stretch the feed wire 56 under adequate tension so that the wire 56 is tightly wound around the feed rollers 62 and 64**.

In the above construction, when the solenoid 82 of the tension remove section **78*b* is energized, it pulls the arm 80 in a wire loosening direction against the action of the tension apply section 78*a* and, thereby, frees the wire 56 from the tension. Although not shown in the drawings, a ribbon cassette is loaded on the top of the carriage 50 and has a take-up spool engaging with the ribbon drive shaft 76**.

In operation, when the carriage 50 strokes to the right in the drawings in response to a print command, the feed rollers 62 and 64 around which the feed wire 56 is wound are caused to swing counterclockwise through the bracket 72 subjected to a force which is opposite in direction to the movement of the carriage 50. This causes one drive gear, 66, out of mesh with the ribbon drive gear 70 and the other drive gear, 68, into mesh with the ribbon drive gear 70. Every time the carriage strokes to the right for printing out data, it causes the feed rollers 62 and 64 to rotate through the feed wire 56 with the result that the rotation of the drive gear 68 is transmitted to the ribbon drive gear 70 to feed the ribbon.

As the carriage 50 strokes in the opposite direction to the above-mentioned (in the case of both-way printing), the drive gear 66, instead of the drive gear 68, is brought into mesh with the ribbon drive gear 70. Since the feed wire 56 is wound around the feed rollers 62 and 64 such that the rollers 62 and 64 rotate in opposite directions to each other as previously stated, the ribbon drive gear 70 always rotates in one direction with no regard to the position of the rollers 62 and 64.

While the carriage 50 moves a distance which does not need ribbon feed such as during tabulated movement (spacing) or carriage return, a tension remove signal is applied to the tension control assembly 78 synchronized with the movement of the carriage 50 to temporarily remove the tension from the wire 56. Then, the wire 56 around the feed rollers 62 and 66 becomes slackened to be prevented from rotating the feed roller 62 or 64 any further. In this manner, the ribbon feed responsive to the movement of the carriage 50 is interrupted while the tension in the wire 56 is removed, thereby eliminating wasteful feed of the ribbon.

In summary, it will be seen that the present invention provides a ribbon feed mechanism which is simple in construction, cost-effective, and free from wasteful ribbon feed. The mechanism of the present invention is applicable to a printer without any modification thereto, whether the latter be of the type printing out data during forward or return movement of a carriage only or the type printing out data during both the forward and return movements.

Various modifications will become possible for those skilled in the art after receiving the teachings of the present disclosure without departing from the scope thereof.

What is claimed is:

1. In a carriage of a printer, said carriage movable in a first direction, a ribbon feeding mechanism comprising:

wire means extending in said first direction;

means for tensioning said wire means;

ribbon drive gear means rotatably mounted on said carriage;

a bracket pivotably mounted on said carriage about an axis extending transverse to said first direction and parallel to an axis of rotation of said ribbon drive gear means;

a first feed roller rotatably mounted on one leg of said bracket and having said wire means wound thereabout, said first feed roller including first gear means, said first feed roller being positionable such that said first gear means are meshable with said ribbon drive gear means upon pivoting of said bracket in a first sense; and a second feed roller rotatably mounted on said bracket and having said wire means wound thereabout in a sense opposite that of first feed roller, said second feed roller being non-coaxial with said first feed roller, said second feed roller including second gear means, said second feed roller being positionable such that said second gear means are meshable with said ribbon drive gear means upon pivoting of said bracket in a second sense opposite said first sense, whereby movement of said carriage in opposite senses of said first direction causes pivoting of said bracket and alternative meshing of said first and second gear means of said feed rollers with said ribbon drive gear means.

2. A ribbon feed mechanism as claimed in claim 1, wherein the wire means comprises a single length of wire.

3. A ribbon feed mechanism as claimed in claim 2, wherein the wire means is wound around the first and second feed rollers at least one turn.

4. The carriage of claim 1 wherein axes of rotation of said first and second feed rollers and said pivot axis of said bracket form corners of triangle.

5. The carriage of claim 1 wherein said bracket is V-shaped and said first and second feed rollers are respectively mounted on legs of said V-shape.

6. In a carriage of a printer, said carriage movable in a firt direction, a ribbon feeding mechanism comprising:

wire means extending in said first direction;

tension control means for selectively activating said means for tensioning;

means for tensioning said wire means;

ribbon drive gear means rotatably mounted on said carriage;

a bracket pivotably mounted on said carriage about an axis extending transverse to said first direction and parallel to an axis of rotation of said ribbon drive gear means;

a first feed roller rotatably mounted on one leg of said bracket and having said wire means wound thereabout, said first feed roller including first gear means, said first feed roller being positionable such that said first gear means are meshable with said ribbon drive gear means upon pivoting of said bracket in a first sense; and a second feed roller rotatably mounted on said bracket and having said wire means wound thereabout in a sense opposite that of first feed roller, said second feed roller being non-coaxial with said first feed roller, said second feed roller including second gear means, said second feed roller being positionable such that second gear means are meshable with said ribbon drive gear means upon pivoting of said bracket in a second sense opposite said first sense, whereby movement of said carriage in opposite senses of said first direction causes pivoting of said bracket and alternative meshing of said first and second gear means of said feed rollers with said ribbon drive gear means.

7. A ribbon feed mechanism as claimed in claim 6, wherein the tension control means comprises a spring anchored to one end of the wire means for applying tension to the wire means.

8. A ribbon feed mechanism as claimed in claim 7, wherein the tension control means further comprises tension remove means for removing the tension from the wire means in opposition to the spring.

9. A ribbon feed mechanism as claimed in claim 8, wherein the tension remove means comprises an electromagnetic arm connected with the spring and the wire means and a solenoid for moving said electromagnetic arm in a direction for removing the tension from the wire means.

10. In a carriage of a printer, said carriage movable in a first direction, a ribbon feeding mechanism comprising:

a single wire extending in said first direction;

means for tensioning said single wire;

ribbon drive gear means rotatably mounted on said carriage;

a bracket pivotably mounted on said carriage about an axis extending transverse to said first direction and parallel to an axis of rotation of said ribbon drive gear means;

a first feed roller rotatably mounted on one leg of said bracket and having said single wire wound thereabout, said first feed roller including first gear means, said first feed roller being positionable such that said first gear means are meshable with said ribbon drive gear means upon pivoting of said bracket in a first sense; and a second feed roller rotatably mounted on said bracket and having said single wire wound thereabout in a sense opposite that of first feed roller, said second feed roller being non-coaxial with first feed roller; said second feed roller including second gear means, said second feed roller being positionable such that said second gear means are meshable with said ribbon drive gear means upon pivoting of said bracket in a second sense opposite said first sense, whereby movement of said carriage in opposite senses of said first direction causes pivoting of said bracket and alternative meshing of said first and second gear means of said feed rollers with said ribbon drive gear means.

* * * * *